US006543612B2

(12) United States Patent
Lee et al.

(10) Patent No.: US 6,543,612 B2
(45) Date of Patent: Apr. 8, 2003

(54) CONTAINER FOR COMPOSITIONS MADE OF TWO OR MORE COMPONENTS

(75) Inventors: Robert Lee, Lake Elmo, MN (US); Robert W. Petrich, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/862,126

(22) Filed: May 21, 2001

(65) Prior Publication Data

US 2002/0170834 A1 Nov. 21, 2002

(51) Int. Cl.[7] ..... B65D 81/32
(52) U.S. Cl. ..... 206/222
(58) Field of Search ..... 206/219–222, 206/568; 215/DIG. 8

(56) References Cited

U.S. PATENT DOCUMENTS

| | | | | |
|---|---|---|---|---|
| 2,288,895 A | * | 7/1942 | Fink | 206/222 |
| 2,612,163 A | | 9/1952 | Norman | |
| 2,624,011 A | | 12/1952 | Stern | |
| 2,862,616 A | | 12/1958 | Capozzi et al. | |
| 3,010,598 A | * | 11/1961 | Foss | 206/222 |
| 3,340,873 A | | 9/1967 | Solowey | |
| 3,359,361 A | | 12/1967 | Oakman | |
| 3,554,705 A | | 1/1971 | Johnston et al. | |
| 3,750,907 A | | 8/1973 | Steele | |
| 3,779,372 A | * | 12/1973 | De Lioret | 206/222 |
| 4,152,269 A | | 5/1979 | Babson | |
| 4,247,001 A | * | 1/1981 | Wiegner | 206/222 |
| 4,331,264 A | | 5/1982 | Staar | |
| 4,537,303 A | | 8/1985 | Muhlbauer | |
| 4,538,920 A | | 9/1985 | Drake | |
| 4,611,715 A | | 9/1986 | Redmond | |
| 4,836,370 A | * | 6/1989 | Bosshard | 206/222 |
| 4,952,068 A | | 8/1990 | Flint | |
| 5,038,951 A | * | 8/1991 | Rizzardi | 206/222 |
| 5,297,698 A | | 3/1994 | Martin | |
| 5,494,192 A | | 2/1996 | Redmond | |
| 5,660,273 A | | 8/1997 | Discko, Jr. | |
| 5,722,829 A | | 3/1998 | Wilcox et al. | |
| 5,735,437 A | | 4/1998 | Broyles et al. | |
| 5,743,736 A | | 4/1998 | Folko et al. | |
| 5,782,345 A | * | 7/1998 | Gausch et al. | 206/222 |
| 5,794,632 A | | 8/1998 | Gueret | |
| 5,860,806 A | | 1/1999 | Pranitis, Jr. et al. | |
| 5,874,045 A | | 2/1999 | Chisum | |
| 5,971,140 A | * | 10/1999 | Frutin | 206/222 |
| 5,989,229 A | | 11/1999 | Chiappetta | |
| 5,996,782 A | | 12/1999 | Sperry et al. | |
| 6,083,002 A | | 7/2000 | Martin et al. | |
| 6,095,813 A | | 8/2000 | Broyles | |
| 6,105,761 A | | 8/2000 | Peuker et al. | |
| 6,152,296 A | * | 11/2000 | Shih | 206/222 |

FOREIGN PATENT DOCUMENTS

| | | |
|---|---|---|
| DE | 2432290 | 1/1976 |
| EP | 1 163 918 | 12/2001 |
| WO | WO 93/1499 | 8/1993 |

OTHER PUBLICATIONS

Pending U.S. patent application Ser. No. 09/838,875 .
Pending U.S. patent application Ser. No. 09/736,602.

* cited by examiner

*Primary Examiner*—Jim Foster
(74) *Attorney, Agent, or Firm*—James D. Christoff

(57) ABSTRACT

A container for a composition made of multiple components includes an outer housing having a chamber and an inner housing having a compartment. The inner housing includes a frangible wall portion that, when ruptured, enables the components to contact each other for mixing. Advantageously, the inner housing can be manufactured separately from the outer housing, and the housings can be assembled during a subsequent operation. In certain embodiments, the inner housing is slidable relative to the outer housing from a first position to a second position, and during the sliding movement a puncturing tool located within the container breaks the frangible wall portion and causes the components to contact each other.

30 Claims, 3 Drawing Sheets

CONTAINER FOR COMPOSITIONS MADE OF TWO OR MORE COMPONENTS

BACKGROUND OF THE INVENTION

1. Field of the Invention

This invention relates to a storage and dispensing container for compositions that are made of two or more components. The container stores at least two of the components in isolation from each other until a quantity of the composition is needed for use.

2. Description of the Related Art

Many useful compositions are made of two components that are not normally mixed together until immediately prior to the time that a quantity of the composition is needed for use. For example, the components of epoxy-based adhesives are stored separately from each other, because once the components come into contact with each other a chemical reaction is undertaken that eventually turns the mixed composition into a hardened mass. For that reason, epoxy-based adhesives are widely available in packages that include two compartments or two separate containers that keep the components of the adhesive initially isolated from each other.

Some packages for multiple-component compositions are relatively large and include a sufficient quantity of the components for multiple applications at different times. For example, epoxy adhesives are commonly available in bulk containers such as cans, jars and squeezable tubes. One component of the adhesive (often called "Part A") is supplied in one bulk container, and the other component (often called "Part B") is supplied in another container that typically matches the first container in shape and construction. Such bulk containers are in widespread use because the costs of packaging the components are relatively low.

To prepare an adhesive from the components stored in bulk containers, a quantity of each component is measured, withdrawn from the container and transferred to a mixing location. The mixing location may be a mixing well, a mixing pad or a third container. Next, the user mixes the components and, using a spatula, brush or other suitable tool, transfers the mixed components to an application site.

However, the practice of supplying multiple-component compositions in two bulk containers is not entirely satisfactory. If, for example, the user does not withdraw the components from the bulk containers in the proper ratio, the characteristics of the resulting composition may be significantly impaired. Additionally, the portion of the components that remains in the container may be adversely affected over a period of time by exposure to the atmosphere once the container is opened. The user is also compelled to dispose of the mixing pad, well or other mixing container after a single use, or undertake an effort to clean the same in preparation for a subsequent use. Furthermore, care must be taken to ensure that the component from one container is not inadvertently transferred to the remaining bulk container where it might contaminate the other component or initiate a chemical reaction that adversely affects the characteristics of the other component.

In recent years, there has been increased interest in "single use" containers for compositions made of two components that are initially kept apart from each other. Such containers typically avoid the need to measure out separate quantities of each component before mixing. These containers also help assure that the components, when mixed, are present in the desired ratio of the resulting composition. Additionally, if the components are mixed together within the container, the need for a mixing well, pad, container or other type of mixing structure is avoided.

Compositions made of two or more components that are initially kept separate from each other are also widely used in the field of medicine and dentistry, including orthodontia. For instance, many adhesives and cements used in dentistry are made of two components that are not mixed together until immediately prior to use. Examples of two-component dental compositions include RelyX ARC dental cement and F2000 primer/adhesive, both from 3M Company.

Single use containers for multiple component compositions are especially convenient for storing medical and dental compositions, because the container along with the applicator can be disposed of after use for a single patient. In this manner, the risk of transferring an infectious disease from one patient to another is substantially reduced. Oftentimes, only a relatively small quantity of the composition is needed at any one time, and the smaller "single dose" or "single use" containers help ensure that a freshly-mixed batch of the composition is available when needed.

Examples of containers that are especially suitable for isolated storage of components for multiple component compositions are described, for example, in U.S. Pat. Nos. 5,735,437, and 5,743,736. However, there is a continuing need to improve the state of the art so that the costs of manufacturing the containers is reduced. Preferably, such a container would be easy to use and yet provide reliable assurance that the shelf life for the stored components is satisfactory.

SUMMARY OF THE INVENTION

The present invention is related to an improved container for compositions that are made of two or more components. The container is especially suitable for single-use applications, such as those found in the field of dentistry. The container may be used for mixing and dispensing of the components in addition to storage of the components, such that the need to transfer the components to a separate location for mixing is rendered unnecessary.

In more detail, the present invention is directed in one aspect to a container for a composition made of two or more components. The container includes an outer housing having a chamber and an inner housing having a compartment. The inner housing includes a frangible wall portion and a first opening spaced from the frangible wall portion. A cover extends across the first opening. A first component is received in the chamber, and a second component is received in the compartment. The inner housing is received in the outer housing. The first component contacts the second component when the frangible wall portion is ruptured.

The present invention is also directed in another aspect to a container for a composition made of two or more components. In this aspect, the container includes an outer housing having a chamber and a puncturing tool. The container also includes an inner housing slidably received in the chamber of the outer housing. The inner housing has a compartment with a frangible wall portion. A first component is received in the chamber and a second component is received in the compartment. The inner housing is slidable in the chamber from a first position where the frangible wall portion is spaced from the puncturing tool to a second position where the frangible wall portion is ruptured by the puncturing tool such that the first component and the second component come into contact with each other.

The container according to the invention is an advantage, in that the inner housing can be manufactured separately from the outer housing if desired. As a consequence, the manufacturing steps of installing the frangible wall portion, connecting the cover and adding the two components to the container is facilitated. Optionally, both the inner housing and the outer housing can be inexpensively made of a plastic material and the cover and/or the frangible wall portion can be made using a metallic foil or plastic film that is fixed in place by a heat seal. As a result, the costs of the container are relatively low.

These and other features of the invention are described in more detail in the paragraphs that follow and are illustrated in the accompanying drawings.

DETAILED DESCRIPTION OF THE PREFERRED EMBODIMENTS

Figure 1:
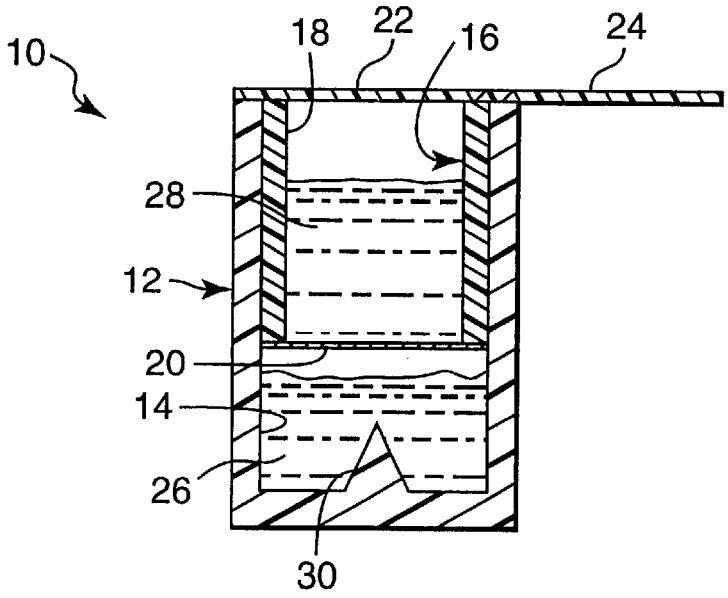
FIG. 1 is a side cross-sectional view of a container for a composition made of two or more components according to one embodiment of the present invention.
Figure 2:
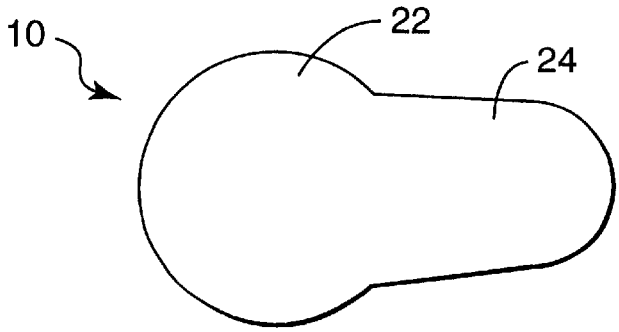
FIG. 2 is a top view of the container shown in FIG. 1.
Figure 3:
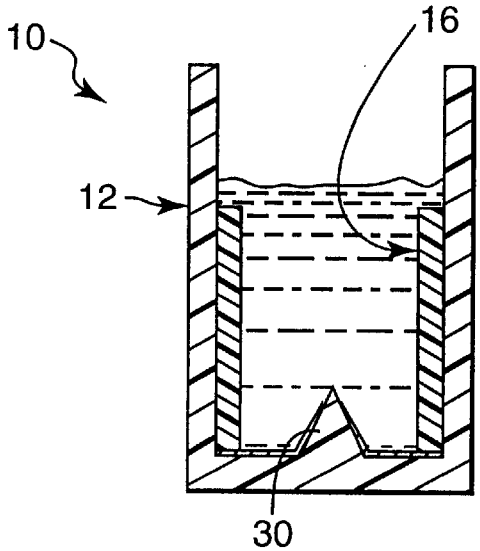
FIG. 3 is a view somewhat similar to FIG. 1 except that an inner housing of the container has been moved in a downwardly direction in order to fracture a frangible wall portion of the inner housing and mix components of the composition together.

A container for a composition made of two or more components is illustrated in FIGS. 1–3 and is broadly designated by the numeral 10. The container 10 includes an outer housing 12 having a chamber 14. In the orientation shown in the drawings, the container 10 has a lower closed end, an upper open end and presents an overall cylindrical configuration.

The container 10 also includes an inner housing 16 having a compartment 18 as shown in FIGS. 1 and 3. The inner housing 16 includes a tubular body having an overall cylindrical configuration with a second end presenting an upper opening or ("first opening"). The inner housing 16 also includes a frangible wall portion that is connected to a first or lower end of the body and spaced from the upper opening. The outer diameter of the inner housing 16 is preferably just slightly less than the inner diameter of the outer housing 12, but is sufficiently small so that the venting of air from the chamber 14 is facilitated when the inner housing 16 is moved toward the bottom of the outer housing 12.

The container 10 includes a cover 22 that is also shown in FIG. 2. The cover 22 extends across the upper or first opening of the inner housing 16, as well as an upper opening (or "second opening") of the outer housing 12. The cover 22 includes a first circular section having a radius approximately equal to the radius of the outer housing 12 as well as a second section that extends laterally outwardly from the first section. The second section extends past the outer housing 12 and present s a tab 24 for gripping the cover 22 when desired.

A first component 26 of a multiple-component composition is received in the chamber 14. In the embodiment shown in the drawings, the first component 26 is located below the frangible wall portion 20 of the inner housing 16. A second component 28 of the multiple-component composition is received in the compartment 18.

The inner housing 16 is slidable in the outer housing 12 from a first position that is shown in FIG. 1 to a second position that is shown in FIG. 3. In the first position of the inner housing 16, the frangible wall portion 20 is spaced from a puncturing tool 30 that extends upwardly from the lower end wall of the outer housing 12. When the inner housing 16 is moved to the second position as shown in FIG. 3, the puncturing tool 30 engages and then ruptures the frangible wall portion 20, enabling the first component 26 and the second component 28 to contact each other.

In use, the cover 22 is removed and the user shifts the inner housing 16 in a downwardly direction, preferably using an applicator. Preferably, the applicator is placed against the upper, now-exposed end of the inner housing 16 while the user holds the outer housing 12 or rests the outer housing 12 on a suitable surface. By placing the applicator against the upper end of the inner housing 16 (instead, for example, of placing the applicator against the upper side of the frangible wall portion 20), the tip of the applicator does not contact the upper end of the puncturing tool 30 or come into contact with the second component 28 until such time as the first component 26 and the second component 28 have been brought together.

An example of a suitable applicator is the "MICROBRUSH" brand applicator from Microbrush Corporation of Orlando, Flo. The "MICROBRUSH" brand applicator has a tip with a plurality of relatively short, flocked fibers. In addition to facilitating mixing of the components 26, 28 after the frangible wall portion 20 has been punctured, the flocked fibers also help to spread the resulting mixed composition across an application site, such as a prepared cavity surface of a tooth.

The outer housing 12 may be made of any material that is suitable for containing the first component 26 for a relatively long period of time. If the resulting mixed composition is an adhesive, the outer housing 12 may be made (for example) of polypropylene, polyethylene and cyclic olefin copolymers. Those plastics could be coated if desired (for example, with a metallic or polymer coating) in order to reduce the transfer of gas molecules through the outer housing 12. Furthermore, those plastics could contain light blocking agents (such as pigments or colorants) if desired, depending upon the characteristics of the stored components.

Similarly, the inner housing 16 may also be made of a plastic material such as polypropylene, polyethylene or cyclic olefin copolymers. Optionally, the plastic material of the inner housing 16 is coated to prevent the transfer of gas molecules. As an additional option, the plastic material may be transparent, translucent or tinted to a relatively light color such as white. In some instances, it may be desirable to provide a black outer housing 12 and a white inner housing 16 because such construction enables the user to readily observe and visually confirm that the puncturing tool 30 (which in this instance is black) has penetrated through the white frangible wall portion 20.

If desired, the frangible wall portion 20 may be constructed by molding the inner housing 16 as a single, unitary component and arranging the molding dies so that the frangible wall portion is relatively thin and readily broken. As another option, the frangible wall portion 20 may be provided by securing a membrane to the cylindrical body.

Examples of suitable frangible membranes include metallic foils such as 0.002 in. (0.05 mm) thick aluminum foil. Optionally, the foil is secured to the lower end of the cylindrical body of the inner housing 16 by an adhesive such as a heat seal adhesive. A suitable metallic membrane with a heat seal coating is "SAFE-GARD" brand material, No. 602, from Unipac Corporation.

The cover 22 is also made of a material that provides suitable barrier properties for the components 26, 28. An example of a suitable material for the cover 22 is a metallic foil (such as aluminum foil) having a heat-seal adhesive coating, such as 0.0015 in (0.04 mm) nominal thickness aluminum foil with heat-seal adhesive coating, specification no. 10038 from Lawson Mardon Packaging.

Preferably, the cover 22 is bonded to the upper end of both the inner housing 16 and the upper end of the outer housing 12. As a result, the cover 22 presents a seal between the atmosphere and the compartment 18, as well as between the atmosphere and the chamber 14. Preferably, the cover 22 can be detached from the housings 12, 16 by grasping the tab 24 and then peeling the cover 22 away from the housings 12, 16.

Optionally, the inner cylindrical surface of the inner housing 16 and/or the upper surface of the lower end of the outer housing 12 includes a plurality of protrusions that present a roughened texture. The protrusions, if provided, facilitate mixing of the components 26, 28 once the frangible wall portion 20 has been ruptured.

Examples of suitable protruding structures include rods, cones, pyramids, truncated pyramids, ribs, bumps and fibers. The roughened texture may also present a plurality of discreet recesses, grooves, cavities or pores that are spaced apart from each other or are interconnected with each other. Optionally, the protrusions are in the form of elongated ribs that extend in a direction parallel to a central, longitudinal axis of the container 10.

Other constructions for the container 10 are also possible. For example, the puncturing tool 30 may have a shape other than the shape of a cone, such as a pyramid, an upstanding rod or a spike having an "X" or cross-shaped configuration in horizontal section. The puncturing tool 30 may also have an annular shape in horizontal cross-section. Additionally, the housings 12, 16 may have cross-sectional shapes when viewed in horizontal reference planes that are shapes other than cylindrical. Moreover, although the upper ends of the housings 12, 16 are shown in aligned relationship (i.e., lying in a common horizontal reference plane) when the inner housing 16 is in its first position, it is also possible for the upper end of the inner housing 16 to lie above or below the upper end of the outer housing 12 when the inner housing 16 is in the first position. (Preferably, the cover would have a non-planar shape suitable for providing a satisfactory seal in such instances).

The resulting composition may be any one of a number of different compositions as desired. For example, the composition may be an adhesive (such as an epoxy adhesive) used for household, commercial or industrial purposes. As another option, the composition may be an adhesive or cement used in medical or dental fields, including orthodontia. Other types of compositions are also possible. Furthermore, one (or in some instances both) of the components 26, 28 may be a liquid, a solid (such as a powder or pellet), a semi-liquid, a paste or a gel.

The container 10 is an advantage, in that the inner housing 16 is manufactured separately from the outer housing 12. As a result, the frangible wall portion 20 can be easily fixed to the lower end of the inner housing 16 before such time as the first component 26 is added to the chamber 14 and before the inner housing 16 is placed within the outer housing 12. Once the inner housing 16 (including the frangible wall portion 20) is manufactured, the assembly of the inner housing 16 and the outer housing 12 can be readily carried out.

Figure 4:
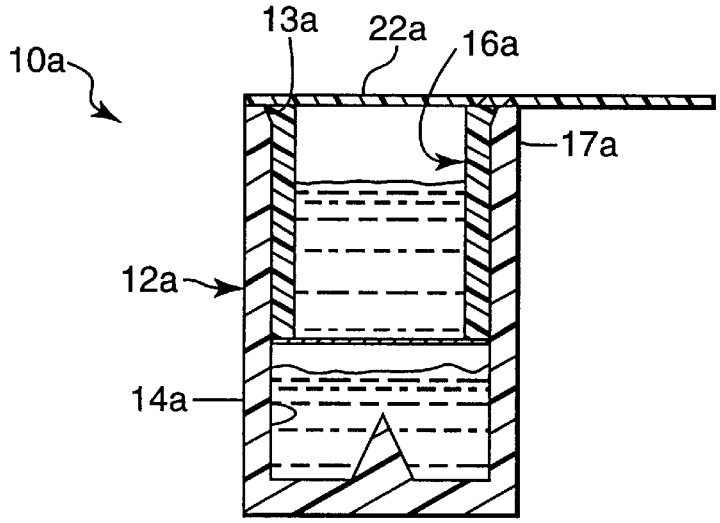
FIG. 4 is a view somewhat similar to FIG. 1 except that the container shown in FIG. 4 is constructed according to another embodiment of the invention.

A container 10*a* according to another embodiment of the invention is illustrated in FIG. 4. Except for the differences noted below, the container 10*a* is essentially the same as the container 10 described above. As such, a detailed description of the common aspects and features need not be repeated.

The container 10*a* includes an outer housing 12*a* having a recess 13*a* near its upper end. Preferably, the recess 13*a* extends around the entire inner periphery of the upper edge portion of the outer housing 12*a*.

An inner housing 16*a* of the container 10*a* also has an upper end, and the upper end includes a flange 17*a* that extends outwardly in lateral directions relative to a central longitudinal axis of the container 10*a*. The flange 17*a* extends around the entire outer periphery of the upper edge portion of the inner housing 16*a* and is received in the recess 13*a*.

The flange 17*a* and the recess 13*a* together present a resistance or partial stop to resist downward movement of the inner housing 16*a* relative to the outer housing 12*a*. This resistance helps to retain the upper ends of the housings 12*a*, 16*a* in parallel, aligned relationship during manufacture in order to facilitate bonding of a cover 22*a* to the upper edge of both the outer housing 12*a* and the inner housing 16*a* . The provision of the flange 17*a* and the recess 13*a* may also facilitate establishing a seal between the atmosphere and chamber 14*a* in the outer housing 12*a*.

Preferably, the extent of horizontal extension of the flange 17*a* is not unduly large, so that the user need not exert undue pressure against the inner housing 16*a* in order to slide the inner housing 16*a* in a downwardly direction. The housings 12*a*, 16*a* are sufficiently flexible so that the interference fit relation between the flange 17*a* and the inner surface of the outer housing 12*a* below the recess 13*a* can be easily overcome by the application of manual pressure to the upper edge of the inner housing 16*a*.

Optionally, a clamping mechanism having semi-cylindrical jaws is applied to the outer surface of the upper region of the outer housing 12*a* in the vicinity of the recess 13*a* during manufacture and assembly of the container 10*a*. The clamping mechanism helps ensure that the housings 12*a*, 16*a* remain stationary relative to each other during construction of the container 10*a*. For example, the clamping mechanism may be used to keep the upper ends of the housings 12*a* , 16*a* in flush, aligned relationship during the time that the cover 22*a* is bonded to the upper edges of the housings 12*a* , 16*a* .

Figure 5:
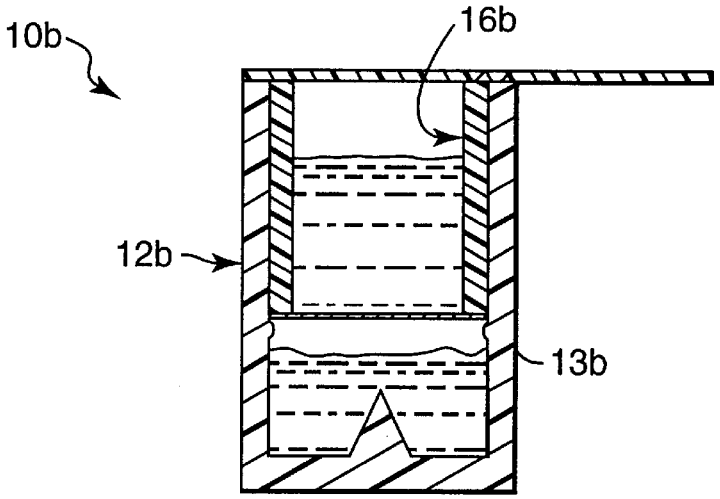
FIG. 5 is a view somewhat similar to FIG. 1 except that the container is constructed in accordance with a further embodiment of the invention.

A container 10*b* according to another embodiment of the invention is illustrated in FIG. 5. The container 10*b* is essentially the same as the container 10*a* shown in FIG. 4, except for the differences noted below.

As depicted in FIG. 5, the container 10*b* includes an outer housing 12*b* having an inwardly directed flange 13*b* that extends along a circular path. The circular path lies in a plane perpendicular to a central, longitudinal axis of the container 10*b*. The upper edge of the flange 13*b* is located directly adjacent a lower end of an inner housing 16*b* during such time that upper ends of the housings 12*b*, 16*b* are in flush, aligned relationship. The flange 13*b* and the lower end of the inner housing 16*b* cooperate to provide an interference-type resistance that may be useful during assembly of the container 10*b*, similar to the function of the flange 17*a* and the recess 13*a* mentioned above.

Figure 6:
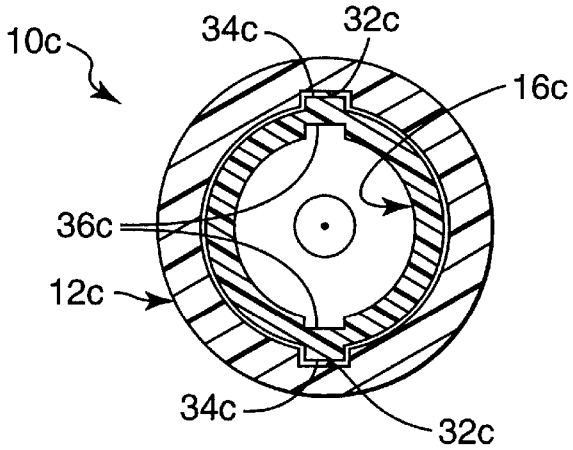
FIG. 6 is a horizontal cross-sectional view of a container for a composition made of two or more components according to yet another embodiment of the invention.

A container 10*c* according to another embodiment of the invention is illustrated in FIG. 6. Except for the differences set out below, the container 10*c* is similar to the containers 10, 10*a* and 10*b* described above. In FIG. 6, the container 10*c* is shown in a cross-sectional view taken along a horizontal reference plane (assuming that a central, longitudinal axis of the container 10*c* is oriented in a vertical direction).

As illustrated in FIG. 6, an outer housing 12*c* of the container 10*c* has a pair of elongated keyways 32*c* that extend in a direction parallel to a central, longitudinal axis of the container 10*c* . Additionally, an inner housing 16*c* of the container 10*c* has a pair of keys 34*c* that extend radially outwardly from the central, longitudinal axis of the container 10*c* . When the keys 34*c* are received in the mating keyways 32*c* , the inner housing 16*c* can be moved in a direction toward a bottom of the outer housing 12*c*.

Initially, the housings 12*c* , 16*c* are oriented such that the keys 34*c* are in a different rotative position relative to the keyways 32*c* and, as such, are not received in the keyways 32*c* . In that initial, non-aligned orientation, the keys 34*c* are located next to a circular horizontal shoulder (not shown) formed in the upper end portion of the outer housing 12*c* . The shoulder blocks downward movement of the keys 34*c* and prevents the inner housing 16*c* from descending in the outer housing 12*c* . The keys 34*c* and the shoulder thus function as a stop to prevent inadvertent movement of the inner housing 16*c* .

However, when a quantity of composition is needed, the user rotates the inner housing 16*c* or the outer housing 12*c* until such time as the keys 34*c* are aligned with the keyways 32*c* . At that time, the inner housing 16*c* may be shifted in a downwardly direction toward the bottom of the outer housing 12*c* . The remaining functions and aspects of the container 10*c* are similar to the container 10 described above.

Optionally, the applicator (not shown) used with the container 10*c* may have protruding structure that fits within inner, upper recesses 36*c* of the inner housing 16*c* . Such protruding structure and recesses can be used to hold the applicator in a stationary rotative position relative to the inner housing 16*c* . As a consequence, the user can rotate the inner housing 16*c* by turning the applicator while holding the outer housing 12*c* stationary (or vice versa) until such time as the keys 34*c* are aligned with the keyways 32*c*.

Figure 7:
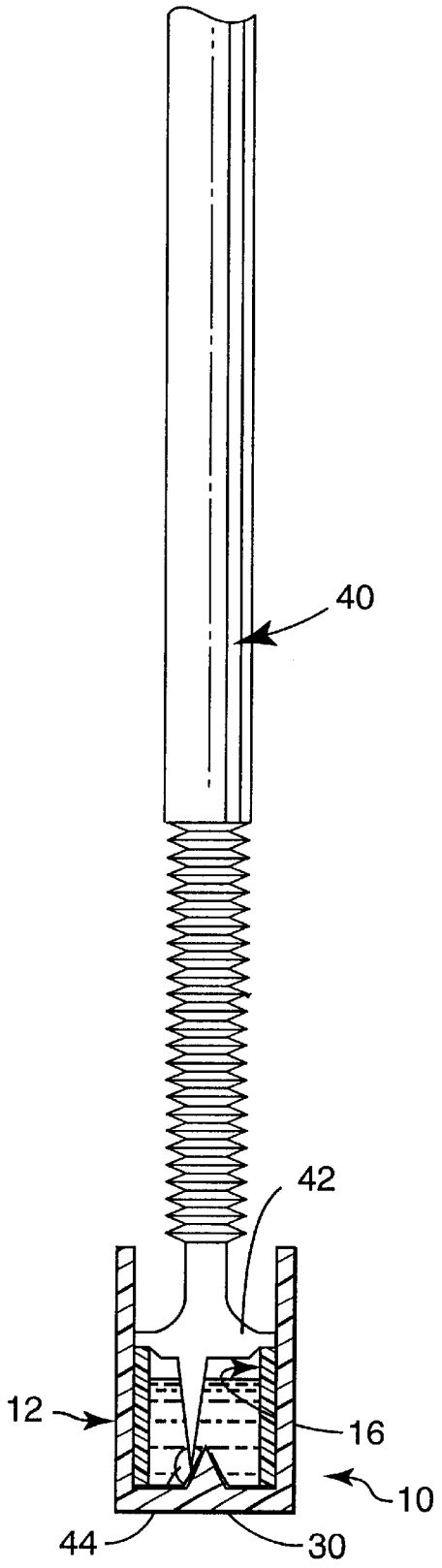
FIG. 7 is a reduced side elevational view in partial section of the container shown in FIG. 1 along with an applicator that is especially useful for moving the inner housing of the container.

FIG. 7 is an illustration of the container 10 described above along with an applicator 40. The applicator 40 is preferably somewhat similar to the "MICROBRUSH" brand applicator described above, except that the applicator 40 also includes a protruding circular rib 42. The outer diameter of the rib 42 is slightly less than the outer diameter of the upper end of the inner housing 16. As a result, the user can shift the inner housing 16 in a downwardly direction when desired by removing the cover (i.e., such as cover 22 shown in FIGS. 1–2) and then inserting the tip of the applicator 40 into the compartment until such time as the rib 42 comes to rest against the upper edge of the inner housing 16. Continued downward pressure on the applicator 40 will then shift the inner housing 16 in a downwardly direction.

Preferably, the rib 42 is spaced from the outer end of the tip 44 a distance that is selected so that the tip 44 does not contact the bottom of the outer housing 12 or inner housing 16 when the inner housing 16 is moved to its second position. In addition, the tip 44 is preferably laterally offset from the longitudinal axis of the applicator 40. Such construction helps to ensure that the tip 44 is not deformed by contact with the puncturing tool 30, especially in instances when the puncturing tool 30 is relatively sharp or when the user exerts excessive pressure on the applicator 40. (In FIG. 7, the amount of lateral offset is exaggerated and need not be as great as shown, especially if the lower end portion of the applicator 40 is flexible).

Optionally, a lower section of the rib 42 is beveled. The lower beveled section helps to align the central axis of the applicator 40 with the central axis of the inner housing 16 so that the rib 42 does not contact the outer housing 12 as the inner housing 16 is moved in a downwardly direction.

Figure 8:
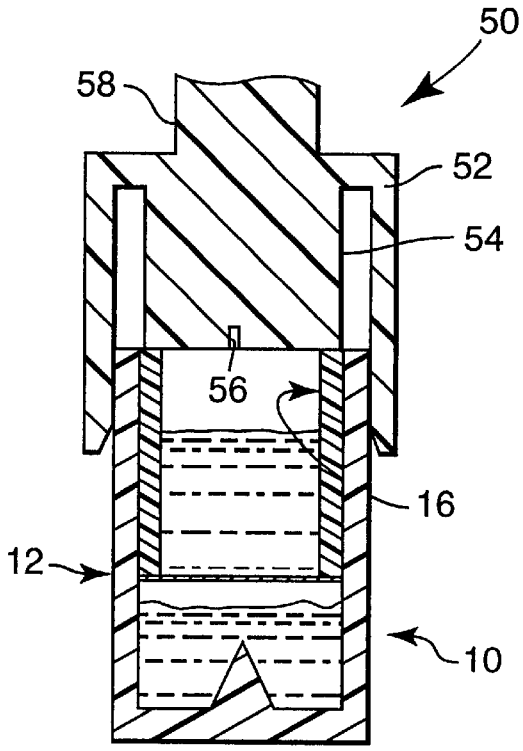
FIG. 8 is a fragmentary, reduced side cross-sectional view of alternative structure that is especially useful for moving the inner housing of the container illustrated in FIG. 1.

FIG. 8 illustrates a device 50 for shifting the inner housing 16 of the container 10. The device 50 includes an outer cylindrical sleeve 52 along with an inner cylindrical sleeve 54. As shown in FIG. 8, the radius of the inner sleeve 54 is approximately the same as the radius of the inner housing 16.

The outer sleeve 52 of the device 50 is spaced from the inner sleeve 54 a distance sufficient to receive the outer housing 12. Moreover, the outer sleeve 52 extends lower than the inner sleeve 54 and has a beveled, inner lower periphery. Such construction helps ensure that the upper end of the outer housing 12 can be readily guided into the space between the inner sleeve 54 and the outer sleeve 52.

As the device 50 is pushed in a downwardly direction, the inner sleeve 54 bears against the upper end of the inner housing 16 while the outer sleeve 52 helps align the device 50 to the container 10. As the device 50 is lowered, the inner housing 16 descends as described above in order to enable components of the composition to contact each other. Preferably, the inner sleeve 54 is provided with at least one vent 56 in order to relieve any pressure in the space above the inner housing 16 as the latter is moved in a downwardly direction.

Preferably, the device 50 includes an elongated handle 58. More preferably, the device 50 is mounted on one end of a handle for an applicator, such as the "MICROBRUSH" brand applicator described above. As a result, the user can simply turn the applicator end-to-end once the device 50 has been used in order to bring the tip (located on the opposite end of the applicator) into contact with the components of the composition.

As an additional option, the device 50 may have a passage aligned with its central longitudinal axis, and detachably connected to the applicator 40. After the device 50 is used to move the inner housing 16, the device 50 is left in place and the user then inserts the applicator tip 44 through the passage to withdraw the composition. The device 50 in that instance could be initially detachably connected to either end of the applicator 40 as desired, or alternatively sold as a separate element.

Figure 9:
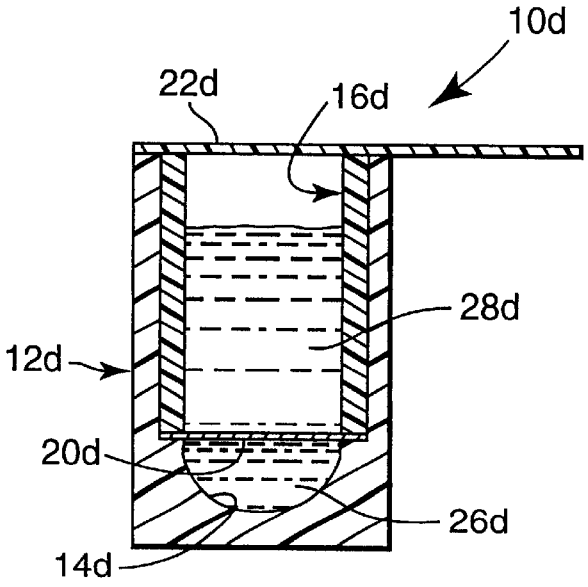
FIG. 9 is a view somewhat similar to FIG. 1 except that the container shown in FIG. 9 is constructed in accordance with still another embodiment of the invention.

A container 10*d* according to another embodiment of the invention is illustrated in FIG. 9. The container 10*d* is essentially the same as the container 10 except for the differences that are noted below.

As shown in FIG. 9, the container 10*d* includes an inner housing 16*d* as well as an outer housing 12*d*. The inner housing 16*d* is snugly received in a cylindrical recess within the outer housing 12*d*. Additionally, the overall length of the inner housing 16*d* in directions along the central longitudinal axis of the container 10*d* is essentially the same as the length of the recess in the outer housing 12*d*. As such, the inner housing 16*d* cannot move downwardly once the upper edges of the housings 12*d*, 16*d* are aligned (i.e., lie in a common reference plane that is perpendicular to the longitudinal, central axis of the container 10*d*.

In use of the container 10*d*, a cover 22*d* is peeled away from the upper edges of the housings 12*d*, 16*d*. Next, an applicator (such as the "MICROBRUSH" brand applicator), is inserted into the compartment 18*d* until it contacts a frangible wall portion 20*d* of the inner housing 16*d*. Continued pressure of the applicator against the frangible wall portion 20*d* punctures the frangible wall portion 20*d* and enables components 26*d*, 28*d* to contact each other.

Preferably, a lower end of a chamber 14*d* is semi-spherical in shape in order to facilitate mixing and dispensing of the mixed composition. As an option, the first component could be received in a pouch (such as a foil pouch) that is placed in the chamber 14*d*. As an additional option, the pouch may be connected to the frangible wall portion 20*d*, or the upper side of the pouch may serve as the frangible wall portion 20*d*.

Optionally, the cover 22*d* is frangible and can be punctured by the applicator. In that instance, the cover 22*d* need not be detached from the housings 12*d*, 16*d*. Instead, the user can simply use the applicator to puncture both the cover 22*d* and the frangible wall portion 20*d* and to withdraw the composition from the chamber 14*d* once the components have been mixed. In that instance, the gripping tab (such as tab 24 as illustrated in FIG. I) can be omitted.

A number of other variations and additions are also possible for all of the constructions mentioned above. Accordingly, the invention should not be deemed limited to the specific, presently preferred embodiments that are set out in detail above, but instead only by a fair scope of the claims that follow along with their equivalents.

What is claimed is:

1. A container for a composition made of two or more components comprising:

an outer housing having a chamber;

an inner housing having a compartment, the inner housing including a tubular body with a first end and a frangible wall portion connected to the first end, the body also including a second end with a first opening spaced from the frangible wall portion, wherein the body is slidable in the chamber from a first position to a second position;

a cover detachably connected to the second end and extending across the first opening;

a first component received in the chamber; and a second component received in the compartment, wherein the inner housing is received in the outer housing, wherein the frangible wall portion is ruptured when the inner housing slides to the second position, and wherein the first component contacts the second component when the frangible wall portion is ruptured.

2. A container for a composition made of two or more components comprising:

an outer housing having a chamber;

an inner housing having a compartment, the inner housing including a frangible wall portion and a first opening spaced from the frangible wall portion;

a cover extending across the first opening;

a first component received in the chamber; and a second component received in the compartment, wherein the inner housing is received in the outer housing, and wherein the first component contacts the second component when the frangible wall portion is ruptured, wherein the inner housing is slidable in the chamber from a first position to a second position, and wherein the outer housing includes a puncturing tool that contacts the frangible wall portion when the inner housing slides from the first position to the second position.

3. A container for a composition made of two or more components according to claim 2 wherein the puncturing tool comprises a projection having a pointed end.

4. A container for a composition made of two or more components according to claim 1 and including a stop for resisting unintentional movement of the inner housing from the first position to the second position.

5. A container for a composition made of two or more components according to claim 1 wherein the inner housing includes a plastic body presenting said first end, and wherein the frangible wall portion comprises a membrane secured to the first end by an adhesive.

6. A container for a composition made of two or more components according to claim 5 wherein the membrane is a metallic foil that is fixed to the body.

7. A container for a composition made of two or more components according to claim 6 wherein the foil is fixed to the body by a heat seal adhesive.

8. A container for a composition made of two or more components according to claim 7 wherein the cover comprises a foil that is fixed to the body by a heat seal adhesive.

9. A container for a composition made of two or more components according to claim 7 wherein the cover extends past the outer housing to present a gripping tab.

10. A container for a composition made of two or more components according to claim 1 wherein the cover extends past the outer housing to present a gripping tab.

11. A container for a composition made of two or more components according to claim 1 wherein the first component and the second component are components of an adhesive.

12. A container for a composition made of two or more components according to claim 11 wherein the adhesive is a dental or orthodontic adhesive.

13. A container for a composition made of two or more components according to claim 11 wherein the adhesive is a epoxy adhesive.

14. A container for a composition made of two or more components according to claim 1 wherein the cover is frangible.

15. A container for a composition made of two or more components according to claim 1 wherein the cover can be detached from the outer housing by peeling the cover away from the outer housing.

16. A container for a composition made of two or more components comprising:

an outer housing having a closed lower end, the outer housing also having a chamber and a puncturing tool extending upwardly from the lower end into the chamber;

an inner housing slidably received in the chamber of the outer housing, the inner housing comprising a tubular body with a first end, the inner housing also having a compartment and a frangible wall portion connected to the first end;

a first component received in the chamber; and a second component received in the compartment, wherein the inner housing is slidable in the chamber from a first position where the frangible wall portion is spaced from the puncturing tool to a second position where the frangible wall portion is ruptured by the puncturing tool such that the first component and the second component come into contact with each other.

17. A container for a composition made of two or more components according to claim 16 wherein the puncturing tool comprises a projection having a pointed end.

18. A container for a composition made of two or more components according to claim 16 and including a stop for resisting unintentional movement of the inner housing from the first position to the second position.

19. A container for a composition made of two or more components according to claim 16 wherein the inner housing includes a plastic body presenting said first end, and wherein the frangible wall portion comprises a membrane secured to the first end by an adhesive.

20. A container for a composition made of two or more components according to claim 19 wherein the membrane is a metallic foil that is fixed to the body.

21. A container for a composition made of two or more components according to claim 20 wherein the foil is fixed to the body by a h eat seal adhesive.

22. A container for a composition made of two or more components according to claim 16 wherein the outer housing also includes an upper opening, wherein the inner housing includes a second end with an upper opening and including a cover detachably connected to the outer housing and extending across the upper opening of the outer housing and the inner housing.

23. A container for a composition made of two or more components according to claim 22 wherein the cover comprises a foil that is fixed to the body by a heat seal adhesive.

24. A container for a composition made of two or more components according to claim 22 wherein the cover extends past the outer housing to present a gripping tab.

25. A container for a composition made of two or more components according to claim 22 wherein the cover extends past the outer housing to present a gripping tab.

26. A container for a composition made of two or more components according to claim 16 wherein the first component and the second component are components of an adhesive.

27. A container for a composition made of two or more components according to claim 26 wherein the adhesive is a dental adhesive.

28. A container for a composition made of two or more components according to claim 26 wherein the adhesive is a epoxy adhesive.

29. A container for a composition made of two or more components according to claim 22 wherein the cover is frangible.

30. A container for a composition made of two or more components according to claim 22 wherein the cover can be detached from the outer housing by peeling the cover away from the outer housing.

* * * * *